US008273696B2

(12) United States Patent
Gibis et al.

(10) Patent No.: US 8,273,696 B2
(45) Date of Patent: Sep. 25, 2012

(54) EMANATOR BLISTER

(75) Inventors: Karl-Ludwig Gibis, Ludwigshafen (DE); Chris Efstathios Housmekerides, Ludwigshafen (DE); Judith Preuschen, Ludwigshafen (DE); Ralf Wiedemann, Ludwigshafen (DE)

(73) Assignee: Reckitt Benckiser N.V., WT Hoofddorp (NL)

( * ) Notice: Subject to any disclaimer, the term of this patent is extended or adjusted under 35 U.S.C. 154(b) by 762 days.

(21) Appl. No.: 10/544,018

(22) PCT Filed: Feb. 3, 2004

(86) PCT No.: PCT/GB2004/000409

§ 371 (c)(1),
(2), (4) Date: Apr. 7, 2006

(87) PCT Pub. No.: WO2004/069982

PCT Pub. Date: Aug. 19, 2004

(65) Prior Publication Data

US 2006/0194710 A1 Aug. 31, 2006

(30) Foreign Application Priority Data

Feb. 3, 2003 (GB) ..... 0302406.4
Mar. 7, 2003 (GB) ..... 0305198.4

(51) Int. Cl.
*C11D 17/04* (2006.01)
*C11D 1/66* (2006.01)
*C11D 1/72* (2006.01)

(52) U.S. Cl. ..... 510/220; 510/221; 510/297; 510/337; 510/356; 510/406; 510/421; 510/439

(58) Field of Classification Search ..... 510/297, 510/439, 220, 221, 337, 356, 406, 421
See application file for complete search history.

(56) References Cited

U.S. PATENT DOCUMENTS

| | | | | |
|---|---|---|---|---|
| 2,663,461 | A * | 12/1953 | Brown | 222/107 |
| 4,286,067 | A * | 8/1981 | Theeuwes | 521/27 |
| 4,356,099 | A | 10/1982 | Tune et al. | |
| 4,776,455 | A | 10/1988 | Anderson | |
| 4,818,422 | A | 4/1989 | Adams | |
| 5,273,186 | A * | 12/1993 | Widmer | 222/50 |
| 5,704,723 | A * | 1/1998 | Salisian | 401/8 |
| 5,759,988 | A * | 6/1998 | Heile et al. | 510/441 |
| 5,886,098 | A * | 3/1999 | Ueda et al. | 525/66 |
| 6,218,013 | B1 * | 4/2001 | Wood et al. | 428/411.1 |
| 6,415,939 | B1 * | 7/2002 | Redmond | 220/266 |
| 6,540,081 | B2 * | 4/2003 | Balz et al. | 206/531 |
| 6,602,466 | B2 * | 8/2003 | Hamilton et al. | 422/37 |
| 2001/0030192 | A1 * | 10/2001 | Redmond | 220/203.08 |

FOREIGN PATENT DOCUMENTS

| | | | |
|---|---|---|---|
| DE | A-4205975 | | 9/1993 |
| EP | 0 345 409 | A | 12/1989 |
| FR | 2585248 | A1 | 1/1987 |
| GB | A-2 066 665 | | 7/1981 |
| WO | WO 81/00051 | A | 1/1981 |
| WO | WO 97/01625 | A | 1/1997 |
| WO | WO 02/079369 | A | 10/2002 |

OTHER PUBLICATIONS

WPI Abstract Acc. No. 2000-574097 [54] & JP 2000135191 A (Teepol Ltd), May 16, 2000.
Combined Search and Examination Report from the Patent Office in Great Britain dated Jul. 14, 2003 for application GB 0302406.4.
Combined Search and Examination Report from the Patent Office in Great Britain dated Jul. 16, 2004 for application GB 0305198.4.
English Language Abstract for FR2585248 taken from esp@cenet.com; Jan. 30, 1987.

* cited by examiner

*Primary Examiner* — Lorna M Douyon
(74) *Attorney, Agent, or Firm* — Norris McLaughlin & Marcus PA

(57) ABSTRACT

The use of an emanator blister, comprising a nonwater soluble membrane, for the release of a surfactant. Also an emanator blister, the emanator comprises a non-water soluble membrane which is suitable for the dispense of a surfactant.

9 Claims, No Drawings

EMANATOR BLISTER

The present invention relates to an emanator blister for emanating an active component. The blister finds particular use in a machine dishwasher, for the emanation of detergent components.

The usual means for dosing detergents and other components required in the dishwashing process include the integrated dispenser of the machine. Powder, tablets and liquid detergents are dosed via this means. The integrated dispenser means usually has to be charged every time the machine is run, which is inconvenient for the consumer.

Some dishwasher active components, such as rinse aid, may be dosed using a multi-dose dispenser which can typically release rinse aid for more than 10 wash cycles. These kind of dispensers are also inconvenient as commonly the warning mechanism, which alerts the need to recharge the dispenser, goes un-noticed by the consumer. Furthermore the dosage means need to be refilled which is inconvenient and often messy Emanators in dishwashers are well known. Where the component is a liquid (such as a fragrance) the emanator may comprise a blister; namely a body containing the liquid to be emanated. Emanation may occur from the blister following piercing or by passage through a permeable blister component.

In permeable blisters, usually the permeable blister component comprises a film/membrane which may be transparent to allow the user to observe the contents of the blister and determine when the blister needs to be changed. The blister contents may be coloured to facilitate this process.

Generally the film/membrane comprises a water insoluble component to avoid being detrimentally affected in use in the dishwasher. Examples of the material used in these films include polymers of unsaturated hydrocarbons (such as ethylene and propylene) which may also be functionalised (for example with halogen such as chlorine). The film/membrane can also be multi-layer and comprise a water-soluble layer which is removed in use and which provides a protective barrier before use.

For example, DE-A-4205975 describes a manufacturing method for a membrane and a membrane composition. The membrane consists of a blend of polyethylene (PE) and 4 to 10 wt % polyethylacrylate (PEEA). The membrane thickness varies between 80 and 140 μm and is coated with a water soluble layer of polyvinyl alcohol (PVA). Both layers are glued together by applying a hydrophobic hot-melt adhesive such as PE. These membrane emanators are used in fragrance release devices, e.g. for use in a dishwasher.

GB-A-2 066 665 describes other membrane materials, such as copolymers of ethylene with vinyl acetate.

A disadvantage of blisters having such films/membranes is that, with blisters intended for multi-cycle dosing, the blisters typically exhibit a non-linear release of the contained component. This has the effect that in the first few washes a relatively large amount of material is released and in later washes a smaller amount of material is released. Obviously this effect is undesirable.

This effect is particularly noticeable when the emanator blister is used to release a fragrance: in the first few washes the amount of fragrance released (such as at the end of the wash cycle to overcome any unpleasant odour associated with washing) is overpowering. Conversely, the amount of fragrance released after several wash cycles can reach, in extreme cases, a negligible/non-perceptible level.

It is an object of the present invention to obviate/mitigate the problems outlined above.

According to a first aspect of the invention there is provided the use of an emanator blister, comprising a non-water soluble membrane, for the release of a liquid detersive active.

The liquid detersive active is preferably a surfactant, a builder, an acid, an enzyme, a corrosion inhibitor or an admixture thereof. Most preferably the liquid detersive active is a surfactant.

Generally the emanator blister is for use in an automatic dishwasher. Alternatively the emanator may be for use in a washing machine.

We have found that emanator blisters in accordance with the present invention display particularly effective linear release of the blister contents. This has been especially noticeable when used in a multi-dose emanator device for the supply of surfactant to, for example, a dishwasher. In this use it has been observed that the amount of emanator surfactant content released per dishwasher cycle is relatively constant. Namely, the release rate appears to be independent of the content of the blister. This is in contrast to previous emanator devices which display a release rate typified by an exponential release curve.

The emanator is most preferably used in the dispense of a surfactant to perform a cleaning operation in the dishwasher.

In this regard the use of the emanator of the present invention has been shown to have excellent release properties. As described above the emanator has been found to show a linear discharge of emanator contents with a uniform amount of content being released per washing cycle in a multi-cycle emanator. Additionally the emanator has been found to display such release properties with surfactants. Thus the emanator allows the preparation of a device which can dispense dishwasher surfactant (with linear release) into a machine dishwasher over a multi-cycle period. This has obvious consumer benefits including the removal of the need for dosing of surfactant with every dishwasher use and also due to the continuous release of surfactant during the whole washing process (including the pre-wash cycle, the main wash cycle, and the rinse cycle) the overall cleaning performance is enhanced/boosted.

Most preferably the surfactant is non-ionic. The surfactant is preferably low-foaming.

The non-ionic surfactant may be a amide surfactant. Polyhydroxy fatty acid amides suitable for use herein are those having the structural formula RCONRZ wherein: $R_1$ is H, $C_1$-$C_4$ hydrocarbyl, 2-hydroxy ethyl, 2-hydroxy propyl, or a mixture thereof, preferable $C_1$-$C_4$ alkyl, more preferably $C_1$ or $C_2$ alkyl, most preferably $C_1$ alkyl (i.e., methyl); and $R_2$ is a $C_5$-$C_{31}$ hydrocarbyl, preferably straight-chain $C_5$-$C_{19}$ alkyl or alkenyl, more preferably straight-chain $C_9$-$C_{17}$ alkyl or alkenyl, most preferably straight-chain $C_{11}$-$C_{17}$ alkyl or alkenyl, or mixture thereof; and Z is a polhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

The non-ionic surfactant may be a condensate of a alkyl phenol. The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide.

The non-ionic surfactant may be an alkoxylated alcohol surfactant. The alkyl alkoxylate condensation products of aliphatic alcohols with from about 1 to about 25 moles of alkylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 20 moles of alkylene oxide per mole of alcohol. Especially preferred are the condensation products of alcohols having an alkyl group containing from 8 to 11 carbon atoms with from about 4 to about 6 moles of alkylene oxide (preferably ethylene oxide) per mole of alcohol. Examples of these especially preferred surfactants include Berol 840 available from AKZO (this has a carbon chain with 8 carbon atoms and 4 ethylene oxide units) and Berol 266 from AKZO (this has a carbon chain with 9 to 11 carbon atoms and 5.5 ethylene oxide units). Both have been found to have an excellent release rate and are low foaming.

The non-ionic surfactant may be ethoxylated/propoxylated fatty alcohol surfactant. The ethoxylated $C_6$-$C_{18}$ fatty alcohols and $C_6$-$C_{18}$ mixed ethoxylated/propoxylated fatty alcohols are highly preferred surfactants for use herein, particularly where water soluble. Preferably the ethoxylated fatty alcohols are the $C_{10}$-$C_{18}$ ethoxylated fatty alcohols with a degree of ethoxylation of from 3 to 50, most preferably these are the $C_{12}$-$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

The non-ionic surfactant may be an EO/PO condensates with propylene glycol. The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

The non-ionic surfactant may be an EO condensation products with propylene oxide/ethylene diamine adducts. The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of non-ionic surfactant include certain of the commercially available Tetronic™ compounds, marketed by BASF.

The non-ionic surfactant may be an alkyl-polysaccharide surfactant. Suitable alkylpolysaccharides for use herein have a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

The surfactant may be a fatty acid amide surfactant. Fatty acid amide surfactants suitable for use herein are those having the formula: wherein R is an alkyl group containing from 7 to 21, preferably from 9 to 17 carbon atoms and each R is selected from the group consisting of hydrogen, $C_3$-$C_4$ alkyl, $C_1$-$C_4$ hydroxyalkyl, and —$(C_2H_4O)_xH$, where x is in the range of from 1 to 3.

Most preferred surfactants are alkoxylated $C_9$-$C_{18}$ alcohols. Such surfactants are commercially available under the Tradenames Plurafac LF 305 (available from BASF) and Synperonic RA 30 (available from Uniquema).

The emanator may be used in the dispense of an admixture comprising a surfactant and a further component. Namely, the emanator may be used to dispense a "2-in-1" additive. A preferred example of a multi-component admixture is one containing a surfactant and a fragrance, especially a fragrance that is intended to be released between wash cycles to address any malodour produced by the moist atmosphere of the dishwasher. The use of the emanator allows dosing of both components at the same time during the whole wash cycle. Additionally if the dishwasher is not in use fragrance may still be continuously released, continuously deodorising the dishwasher. Most preferably the surfactant is combined with a fragrance in the ratio of 99:1 to 1:99. Most preferably the membrane is chemically stable in the presence of common fragrances.

It will be appreciated that the thickness of the membrane in the emanator will have an influence on the rate of release of the emanator contents.

Generally in the emanator it is preferred that the membrane has a thickness of less than 500 μm, more preferably less than 250 μm, more preferably less than 120 μm. Most preferably the membrane has a thickness of between 15 and 100 μm.

Most preferably the membrane is continuous, that is to say the membrane comprises only a limited number of permanent pores/apertures. Without wishing to be bound by theory it is suggested that the liquid detersive active is transported across the membrane by an active transport mechanism.

The membrane may be prepared by any suitable method. Preferred examples of membrane manufacture include casting and blow-moulding.

The membrane may be stabilised with a UV stabiliser or an antioxidant.

The membrane may comprise filling and/or reinforcement materials.

According to a second aspect of the invention there is provide an emanator blister, the emanator comprising a non-water soluble membrane which is suitable for the dispense of a surfactant.

It will be appreciated that features of the first aspect of the invention may be applied mutatis mutandis to the second aspect of the invention.

Generally the membrane is stable in aqueous solutions with a pH of 2 to 13, more preferably 3 to 13 and most preferably 7 to 12.

Most preferably the membrane comprises a polymer.

The emanator may comprise a reservoir body having a substantially planar base with the reservoir projecting from a surface thereof. Most preferably the membrane forms the base of the emanator blister. Preferably the remainder of the reservoir is enclosed in a non-permeable skin. The skin is generally transparent to allow a user to view the contents of the reservoir to determine when a replacement is required. In this form the emanator is particularly suitable for mounting in a cage retaining structure.

Alternatively the emanator may comprise a pouch formed entirely of the membrane.

It will be appreciated that the term blister encompasses both of the structural embodiments contemplated above.

For both the reservoir body and/or the pouch the membrane of the emanator blister preferably has a water soluble polymer layer on the outer surface of the membrane to prevent loss of blister contents during storage.

According to a third aspect of the present invention there is provided an emanator blister including a membrane which comprises a polyetheresteramide having an ordered arrangement of ester and amide functions, wherein the alcohol component comprises a monomeric or oligomeric diol.

It will be appreciated that features of the first and second aspects of the invention may be applied mutatis mutandis to the third aspect of the invention.

The polyetheresteramide may be produced from a lactam.

It is preferred that the content of oligomeric diol, related to the total content of the alcohol component amounts to from 15 to 70 mol %, more particularly from 30 to 60 mol %.

The polyetheresteramide preferably comprises a monomer selected from the group comprising; oligomeric polyols such as polyethylene glycols, polypropylene glycols, polyglycols in block or alternating co-polymers form developed from mixtures of ethylene and/or propylene oxide; polytetrahydrofurans having a molecular weight between 100 and 10,000; and monomeric diols such as $C_2$-$C_{12}$ alkyl diols, in particular $C_2$-$C_6$ alkyl diols (such as ethyleneglycol, 1,4-butanediol, 1,3-propanediol, 1,6-hexanediol.

The polyetheresteramide preferably comprises a monomer selected from the group comprising; dicarboxylic acids such as $C_2$-$C_{12}$ alkyl dicarboxylic acids, particularly $C_2$-$C_6$ alkyl dicarboxylic acids (for example oxalic acid, succinic acid, adipic acid), also esters of these acids (methyl, ethyl etc.); $C_2$-$C_{12}$ alkyl hydroxy acids; $C_5$-$C_{12}$, more preferably $C_6$-$C_{11}$ lactones, especially cyclic lactones such as caprolactam and laurinlactam; $C_2$-$C_{12}$ aminoalcohols such as ethanolamine, propanolamine; and $C_6$-$C_{12}$ omega aminocarboxylic acids such as leucine.

Polyesters which terminate with either a hydroxyl or an acid moiety with molecular weights between 300 and 10,000 as ester component may be used.

The polyetheresteramide may contain a branching agent. Where present the polyetheresteramide may comprise a branching agent in an amount of from 0.05 to 5 wt %, more preferably 0.1 to 2 wt %. The branching agent preferably comprises a trifunctional alcohol such as trimethylolpropane or glycerine; a tetrafunctional alcohol such as pentaerythritol; a trifunctional carboxylic acid such as citric acid; trichloroethylene or a tetrafunctional hydroxy acid. The branching agent may be used to increase the viscosity of the polyetheresteramide such that extrusion blow moulding with the polyetheresteramide is possible.

The portion of the ether and ester portions in the polymer is generally 5 to 85 wt %, preferably 20 to 60 wt %, based on the weight of the total polymer.

Preferably the polyetheresteramide has a molecular weight (determined by gel chromatography in cresol against a polystyrene standard) of 10,000 to 300,000, more preferably from 15,000 to 150,000 and most preferably from 15,000 to 100,000.

The polyetheresteramide may be stabilised with a UV stabiliser or an antioxidant.

Preferred examples of antioxidants comprise compounds which include a sterically hindered phenol, phosphite, phosphonite ester or sulphur group. Preferred examples of UV stabilisers include sterically hindered amines, benzophenone, benzotriazole, benzylidene, malonate, oxanilide, benzooxazinone or triazine. Combinations of sterically hindered amines and phenols are particularly suitable.

The polyetheresteramide may be synthesised by stoichiometric mixing of the polyetheresteramide components (if necessary under additive of water with the subsequent removal of water from the reaction mixture). Alternatively synthesis may be carried out by addition of surplus diol leading to esterification of the acid functions and subsequent transesterification and/or amidation of these esters. In the second case beside water also the surplus of glycol is removed. The reaction generally takes place at low pressure, preferably <5 mbar, in particular <1 mbar. The reaction is operated at between 180 to 280° C. A catalyst (such as titanium and/or phosphorus) may be used for catalysis of the esterification and/or amidation reactions.

The polyetheresteramide membrane may comprise filling and/or reinforcement materials.

The filling and reinforcement materials may be added at up to 80 wt % of the polyetheresteramide membrane. As filling and reinforcement materials generally inorganic materials are used. Preferred reinforcement materials are fibrous materials such as glass and carbon fibres. Also mineral fillers such as talcum powder, mica, chalk, kaolin, wool fibres, gypsum, quartz, dolomite, silicates, soot, cellulose and titanium dioxide may be used. The filling/reinforcement material may be surface-treated. Where fibres are used the fibre diameter is generally between 8 and 14 μm.

The invention will now be described with reference to the following non-limiting Examples.

EXAMPLES

Preparation of Emanator Blister

A bag comprising a membrane was prepared. The bag comprised two 5 cm×5 cm sheets of membrane: it had a surface area of 50 $cm^2$ and an internal volume of 15 $cm^3$. The bag was filled with 4 ml (4 g) of a composition to be emanated in the dishwasher and sealed by heat sealing at the bag periphery.

Method of Evaluation of Blister Emanation:

4 g of the composition to be emanated was placed in a bag as described above. The bag was then placed in a dishwasher (Miele® G686SC) on the upper rack in the plate area and retained with a clip.

The dishwasher was then operated (complete with a commercially available detergent and rinse aid, such as Calgonit Powerball and Rinse aid) for multiple cycles, including a pre-wash cycle and a main wash cycle. After each complete cycle the bag was removed from the machine and weighed to determine the weight loss and hence the amount of bag content that had been emanated in the cycle.

Example 1

An emanator bag comprising a membrane (polyetheresteramide, 100 μm thickness) was prepared and filled with 4 g surfactant (a non-ionic alcohol ethoxylate surfactant available as Plurafac LF 305 from BASF). The bag was placed in a dishwasher as described above, which was operated over multiple cycles. The bag was weighed after each complete cycle.

Table 1 shows the weight of the bag after each complete washing cycle. The weight difference between each cycle is also shown.

TABLE 1

| Number of Cycles | Emanator Weight (g) | Weight Loss (g) |
|---|---|---|
| 0 | 3.933 | — |
| 1 | 3.905 | 0.028 |
| 2 | 3.847 | 0.058 |
| 3 | 3.814 | 0.033 |
| 4 | 3.714 | 0.100 |
| 5 | 3.656 | 0.058 |
| 6 | 3.590 | 0.066 |
| 7 | 3.501 | 0.089 |
| 8 | 3.449 | 0.052 |
| 9 | 3.379 | 0.070 |
| 10 | 3.293 | 0.087 |
| 11 | 3.237 | 0.056 |
| 12 | 3.160 | 0.077 |
| 13 | 3.080 | 0.080 |
| 14 | 3.015 | 0.065 |
| 15 | 2.942 | 0.073 |
| 16 | 2.873 | 0.071 |

The emanator bag shows a linear rate of release of surfactant with increasing number of washes. The average rate of release was 0.065 g per wash. The blister empties completely at 60 washes.

It is surprising that the emanator blister is able to release a surfactant. In the past emanator blisters have only been used for the release of fragrances. The linear release of surfactant is a highly unexpected advantage of an emanator in accordance with the present invention.

The result achieved is further unexpected when compared with previous fragrance emanator blisters which normally release their fragrance content in an exponential release.

Example 2

An emanator bag was prepared as in Example 1 and tested in a dishwashing machine as described above.

In this example the bag was filled with 4 g surfactant (a non-ionic surfactant available as Synperonic RA 30 from Uniquema). The bag was placed in a dishwasher as described above, which was operated over multiple cycles. The bag was weighed after each complete cycle.

Table 2 shows the weight of the bag after each complete washing cycle. The weight difference between each cycle is also shown. In this case the weight loss is expressed in terms of percentage based upon the weight of the emanator at the start of the experiment.

TABLE 2

| Number of Cycles | Emanator Weight (%) | Weight Loss (%) |
|---|---|---|
| 0 | 100 | — |
| 1 | 103.25 | (−3.25) |
| 2 | 105.32 | (−2.07) |
| 3 | 100.31 | 5.01 |
| 4 | 98.93 | 1.38 |
| 5 | 97.66 | 1.27 |

TABLE 2-continued

| Number of Cycles | Emanator Weight (%) | Weight Loss (%) |
|---|---|---|
| 6 | 95.17 | 2.49 |
| 7 | 94.31 | 0.86 |
| 8 | 92.81 | 1.50 |
| 9 | 91.46 | 1.35 |
| 10 | 90.95 | 0.51 |
| 11 | 89.15 | 1.80 |
| 12 | 88.49 | 0.66 |
| 13 | 85.20 | 3.29 |
| 14 | 83.70 | 2.5 |
| 15 | 82.53 | 1.17 |
| 16 | 81.58 | 0.95 |
| 17 | 81.25 | 0.33 |
| 18 | 79.48 | 1.77 |
| 19 | 76.73 | 2.75 |
| 20 | 75.55 | 1.18 |
| 21 | 74.16 | 1.39 |

Apart from in the very early stages of the experiment the emanator bag shows a linear rate of release of surfactant with increasing number of washes. The average rate of release was 1.25% (corresponding to 50 mg) per wash. The blister was completely emptied at wash 80.

The invention claimed is:

1. An emanator blister for an automatic dishwasher or washing machine, the emanator blister comprising a liquid nonionic surfactant and a non-water soluble membrane comprising a polyetheresteramide, wherein the non-water soluble membrane is a multi-cycle emanator blister and adapted to release the surfactant therefrom into the automatic dishwasher or washing machine at a dispense rate, wherein the non-water soluble membrane comprises at least one permanent pore for releasing the surfactant, wherein the non-water soluble membrane has a thickness of less than 500 μm.

2. An emanator blister according to claim 1, wherein the dispense rate is substantially constant.

3. An emanator blister according to claim 1, wherein the nonionic surfactant is an alkoxylated $C_9$-$C_{18}$ alcohol.

4. An emanator blister according to claim 1, wherein the non-water soluble membrane has a thickness of between 15 μm and 100 μm.

5. An emanator blister according to claim 1, wherein the non-water soluble membrane is stabilised with a UV stabiliser or an antioxidant.

6. An emanator blister according to claim 1, wherein the non-water soluble membrane comprises filling or reinforcement materials.

7. An emanator blister according to claim 1, wherein the emanator blister comprises a reservoir body having a substantially planar base formed by the membrane.

8. An emanator blister according to claim 1, wherein the emanator blister comprises a pouch formed of the membrane.

9. An emanator blister according to claim 8, wherein the membrane has a water soluble polymer layer on an outer surface of the membrane.

* * * * *